US006483263B1

(12) United States Patent
Hanna et al.

(10) Patent No.: US 6,483,263 B1
(45) Date of Patent: Nov. 19, 2002

(54) AUTOMATED SYSTEM FOR CONDITIONING A LINEAR ACCELERATOR

(75) Inventors: Samy Hanna, Danville; Sherman Kenney, Pleasant Hill; Rod Loewen, Redwood City, all of CA (US)

(73) Assignee: Siemens Medical Solutions USA, Inc., Iselin, NJ (US)

( * ) Notice: Subject to any disclaimer, the term of this patent is extended or adjusted under 35 U.S.C. 154(b) by 0 days.

(21) Appl. No.: 09/492,983

(22) Filed: Jan. 27, 2000

Related U.S. Application Data

(60) Provisional application No. 60/121,808, filed on Feb. 25, 1999.

(51) Int. Cl.[7] ..... H05H 9/00

(52) U.S. Cl. ..... 315/505; 315/506; 250/505.1; 250/492.3

(58) Field of Search ..... 315/505, 506; 250/505.1, 492.3

(56) References Cited

U.S. PATENT DOCUMENTS

| | | | | |
|---|---|---|---|---|
| 5,216,255 A | * | 6/1993 | Weidlich | 250/492.3 |
| 5,451,794 A | * | 9/1995 | McKeown et al. | 250/492.3 |
| 5,698,954 A | | 12/1997 | Hirota et al. | 315/503 |

FOREIGN PATENT DOCUMENTS

| | | | |
|---|---|---|---|
| GB | 2 344 985 | 6/2000 | G06F/19/00 |
| WO | WO 94/14304 | 6/1994 | H05H/9/00 |

OTHER PUBLICATIONS

Copy of Search Report for GB Appln. No. 0004280.4; date search was completed: Jun. 27, 2000.

* cited by examiner

*Primary Examiner*—Bruce Anderson
*Assistant Examiner*—Nikita Wells

(57) ABSTRACT

A method and system for automatically conditioning a linear accelerator is disclosed. The method and system comprise the steps of measuring the global variables of the accelerator and evaluating a plurality of events based upon the measurement of the global variables in which the plurality of events have a hierarchy of importance. Finally, the method and system includes performing an action in response to the hierarchy of importance of the plurality of events. Accordingly, a system and method in accordance with the present invention allows an accelerator to be conditioned unattended. The system and method in accordance with the present invention combines software and hardware to measure global variables and modifies the condition of the accelerator based upon those variables. Through the use of a system and method in accordance with the present invention conditioning can proceed in small systematic steps, thereby resulting in better-conditioned accelerators. Accordingly, an improvement in both the performance and longevity of the accelerator will result due to the reduction in arcing and dark current. Additionally, a complete record of the conditioning process is automatically generated and archived with the attending benefit of quality control. Finally a significant savings in the overall costs will result from the utilization of a system and method in accordance with the present invention.

13 Claims, 5 Drawing Sheets

AUTOMATED SYSTEM FOR CONDITIONING A LINEAR ACCELERATOR

This application claims benefit of Prov. No. 60/121,808 filed Feb. 25, 1999.

FIELD OF THE INVENTION

The present invention relates to linear accelerators and more particularly to a system for the conditioning of linear accelerators utilized in radiotherapy equipment.

BACKGROUND OF THE INVENTION

Linear accelerators are the core of a radiotherapy device. A linear accelerator is used to produce high energy electrons for tumors, either through a x-ray or through direct application of the electrons to the tumor. The function of the accelerator is to accelerate electrons by feeding electromagnetic waves onto a structure made of, for example, copper to boost the energy of the electrons provided therefrom.

Prior to the use of such an accelerator, there is a requirement that conditioning occur to ensure the proper operation of the radiotherapy device. Conditioning is required because an undesirable characteristic of using such a device is that initially if there is a high field applied to the surface of the copper, electrons will be released from that surface. With this release of electrons arcing can occur, or a dark current is produced inside the accelerator that can affect its performance.

Accordingly, conventionally the accelerator is conditioned manually by an operator. Typically, the operator will manually adjust the high energy field provided to the accelerator from a low value to a high value in a gradual and controlled manner to condition its surface. The high energy field is increased to a level that is above the desired high energy field and then lowered to ensure that the accelerator is operating in an appropriate manner.

The problem with this approach is that an operator is required to monitor the conditioning parameters and change them until the accelerator is conditioned to handle the full power required. This operator control creates two problems. One is that the performance of the accelerator is highly dependent upon the skill of the operator. Therefore, the consistency associated with conditioning is erratic and is dependent upon the particular operator that is using it. Also, this manual process, even when a skilled operator is controlling the conditioning, can require a considerable amount of time.

Secondly, through such a system the detailed history of the process of conditioning is not automatically recorded. Lack of such detailed records impedes the implementation of a tight quality control system for the manufacturing of such accelerators.

Accordingly, what is desired is a system and method which will allow for improved consistency in the conditioning of the accelerator as well as a more cost effective alternative to the manual process as above described. In addition, the system should provide a record for the history of the conditioning of the accelerator. Thus, a better quality control system can be implemented. The system should be easy to implement, should be cost effective and should not add a substantial complexity to the existing systems that are presently available. Accordingly, what is needed is a system and method for conditioning an accelerator in a manner that overcomes the above-mentioned problems. The present invention addresses this need.

SUMMARY OF THE INVENTION

A method and system for automatically conditioning a linear accelerator is disclosed. The method and system comprise measuring the global variables of the accelerator and evaluating a plurality of events based upon the measurement of the global variables in which events has a hierarchy of importance. Finally, the method and system includes performing an action in response to the hierarchy of importance of the plurality of events.

Accordingly, a system and method in accordance with the present invention allows an accelerator to be conditioned unattended. The system and method in accordance with the present invention combines software and hardware to measure global variables and modifies the condition of the accelerator based upon those variables. Through the use of a system and method in accordance with the present invention conditioning can proceed in small systematic steps, thereby resulting in better-conditioned accelerators. Accordingly, an improvement in both the performance and longevity of the accelerator is possible due to the reduction in arcing and dark current. Finally a significant savings in the overall costs will result from the utilization of a system and method in accordance with the present invention.

DETAILED DESCRIPTION OF THE INVENTION

The present invention relates to an automated system for the conditioning of linear accelerators utilized in radiotherapy equipment. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
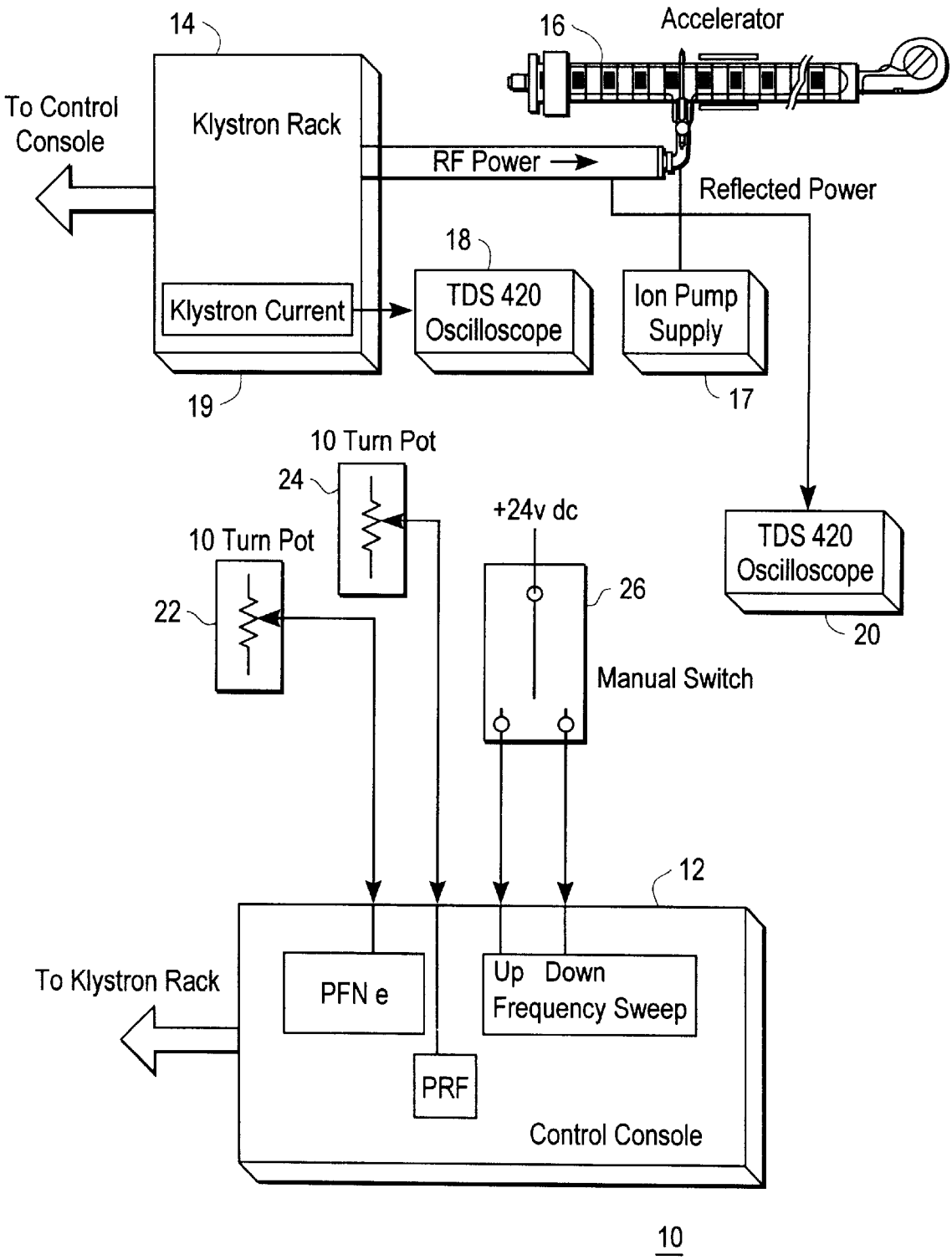
FIG. 1 is a block diagram of a conventional system for conditioning an accelerator.

FIG. 1 is a block diagram of a conventional system 10 for conditioning an accelerator. In this conventional system, there is a control console 12, which controls a Klystron rack 14. The Klystron rack 14 in turn provides RF Power to the accelerator 16, also provides a measure of the Klystron current 19, to an oscilloscope 18. A measure of the reflected RF Power is provided to the oscilloscope 20 from the feed line of the accelerator. One of ordinary skill in the art recognizes that any number of oscilloscopes could be used to provide this information, the key element being such that it is easy to view the various variables via the waveforms on the oscilloscopes. An ion pump supply 17 supplies current to an ion pump (not shown) thereby insuring a vacuum of the accelerator 16 to facilitate the conditioning process.

The control console 12 is controlled by an operator (not shown). The control console 12 provides a signal which varies between 0 and 10 volts which controls the RF power level via a first potentiometer 22. The control console 12 further varies a pulse repetition frequency, via a second potentiometer 24. Finally, the control console 12 also includes a manual switch 26. The manual switch 26 is utilized to sweep the frequency of the Klystron rack 14 either in an up or down direction based upon the condition of the accelerator 16. In use, the operator views the oscilloscopes 18 and 20 and determines from the waveforms on the oscilloscopes 18 and 20 how the controls (potentiometers 22 and 26 and of the control manual switch 28) of the console 12 are to be adjusted to condition the accelerator 16. In this conventional conditioning system 10, the operator must be present at all times to monitor the conditioning which significantly increases the cost of the system 10 as well as is very dependent upon the operator's skill.

Typically, the operator will adjust the high energy field based upon observation of the oscilloscopes 18 and 20 from a low value to a high value in a gradual manner to condition the surface in the accelerator 16. The high energy field is increased to a level that is above the desired high energy field and then reversed until the accelerator system 10 is operating in an appropriate manner.

As above-mentioned, the problem with this approach is that an operator is required to monitor the conditioning parameters and change them until the system 10 is conditioned to handle the full power required. As also before-mentioned, the performance of the system 10 is highly dependent upon the skill of the operator. Therefore, the consistency associated with conditioning is erratic and is dependent upon the particular operator that is using it. Also, this manual process, even when a skilled operator is controlling the conditioning, can require a considerable amount of time.

As has also been before mentioned, a system operator must be present at all times to monitor the conditioning of the system 10. Accordingly, there is the additional expense and cost due to labor associated with the conventional process.

A system and method in accordance with the present invention automatically conditions an accelerator by continually inspecting the current running state (and local history) of the accelerator and stepping up the pulse repetition frequency (PRF) and radio frequency (RF) power until reaching optimum conditioning of the accelerator.

Figure 2:
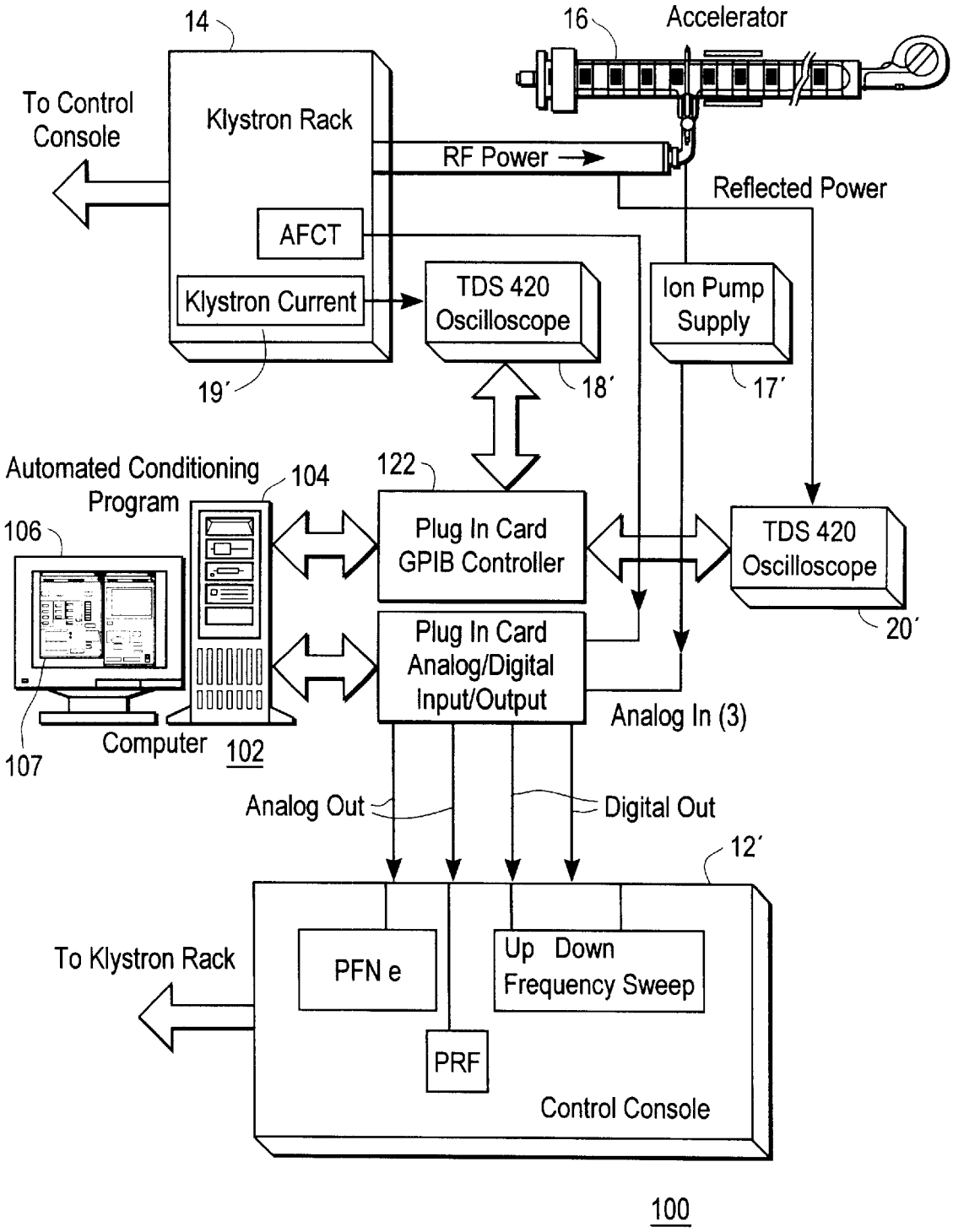
FIG. 2 is a block diagram of the system for conditioning an accelerator in accordance with the present invention.

FIG. 2 is a block diagram of a system 100 for conditioning an accelerator in accordance with the present invention. The system 100 includes a control console 12', a Klystron rack 14', oscilloscopes 18' and 20', ion pump supply 17' and an accelerator 16' which are substantially similar to and have similar reference numbers as the same named elements in FIG. 1. The system 100 also includes an automated conditioning system. As above-mentioned the automated conditioning system is implemented via a computer system change 102. The computer system 102 includes a microprocessor 104. The microprocessor 104 includes an automated conditioning program. As before-mentioned, the conditioning program can be implemented directly from the hard drive of the computer system 102, via CD, floppy disk, Zip Disk, or some other type of computer readable medium within the computer system 102.

In a preferred embodiment, the automated conditioning program is provided via a software program which is utilized by the computer system 102 either on its operating system or on a computer-readable medium such as floppy disk, CD, or other media that can be accessed by the computer system 102. Accordingly, through the use of this system, an operator is not required to condition the accelerator 16' and in addition an operator is not required to continuously monitor the conditioning of the accelerator 16'. Through the use of this program, it is possible for the computer system 102 to continuously monitor the accelerator 16' as the conditioning occurs.

The automated conditioning program in a preferred embodiment causes several virtual interfaces (VI's) to run in parallel and exchange information through a set of global variables. Typically, a plurality of high level VI's are loaded into the memory of the computer system 102. Thereafter, a Take Measurements VI is run continuously to acquire data and to write to global variables. The Take Measurements VI, typically has a wait time (typically one second) during each loop, to allow for updating the Take Measurements VI.

Thereafter, appropriate control values are provided into a Conditioning VI and the automated conditioning program is run. The Conditioning VI controls the start and stopping of the automated conditioning program.

Referring back to FIG. 2, the computer system 102 further includes a display 106. The system 102 can also utilize a pointing device (not shown) and a keyboard (not shown) to control a user interface to the microprocessor 104. The display 106 provides for a user interface to the conditioning program. There are two interfaces 122 and 124 utilized in the automatic conditioning system. Interface 122 in a preferred embodiment is a GPIB controller card which sends and receives signals from the oscilloscopes 18' and 20'. Interface 124 in a preferred embodiment, is an analog/digital input/output plug in card which receives analog signals from the Klystron rack 14' (AFCT) and ion pump supply 12', provides analog signals to control the RF power and the PRF and provides digital signals to control the frequency sweep.

In this embodiment, the RF Power level, PRF, and frequency sweep is controlled via the digital/analog interface 124 to the console 12'. Similarly, an indication of the ion pump supply 17' is provided to the interface 124 and then to computer system 102. In addition, an indication of the automatic frequency control signal (AFCT) is provided via the interface 124 to the computer system 102. The console 12' utilizes the AFCT to control the frequency of the RF power from the Klystron rack 14'.

Finally, the pulse repetition frequency (PRF) and RF Power levels are adjusted via the automated conditioning program. The interface 122 receives the signals from the oscilloscopes 18' and 20' and then provides the results of those signals to the automated conditioning program. The conditioning program sends signals via interfaces 122 and 124 to the control console 12' to cause the console 12' to make the appropriate adjustments to the Klystron rack 14'. As is seen the display 106 includes a user interface screen 107.

Figure 3:
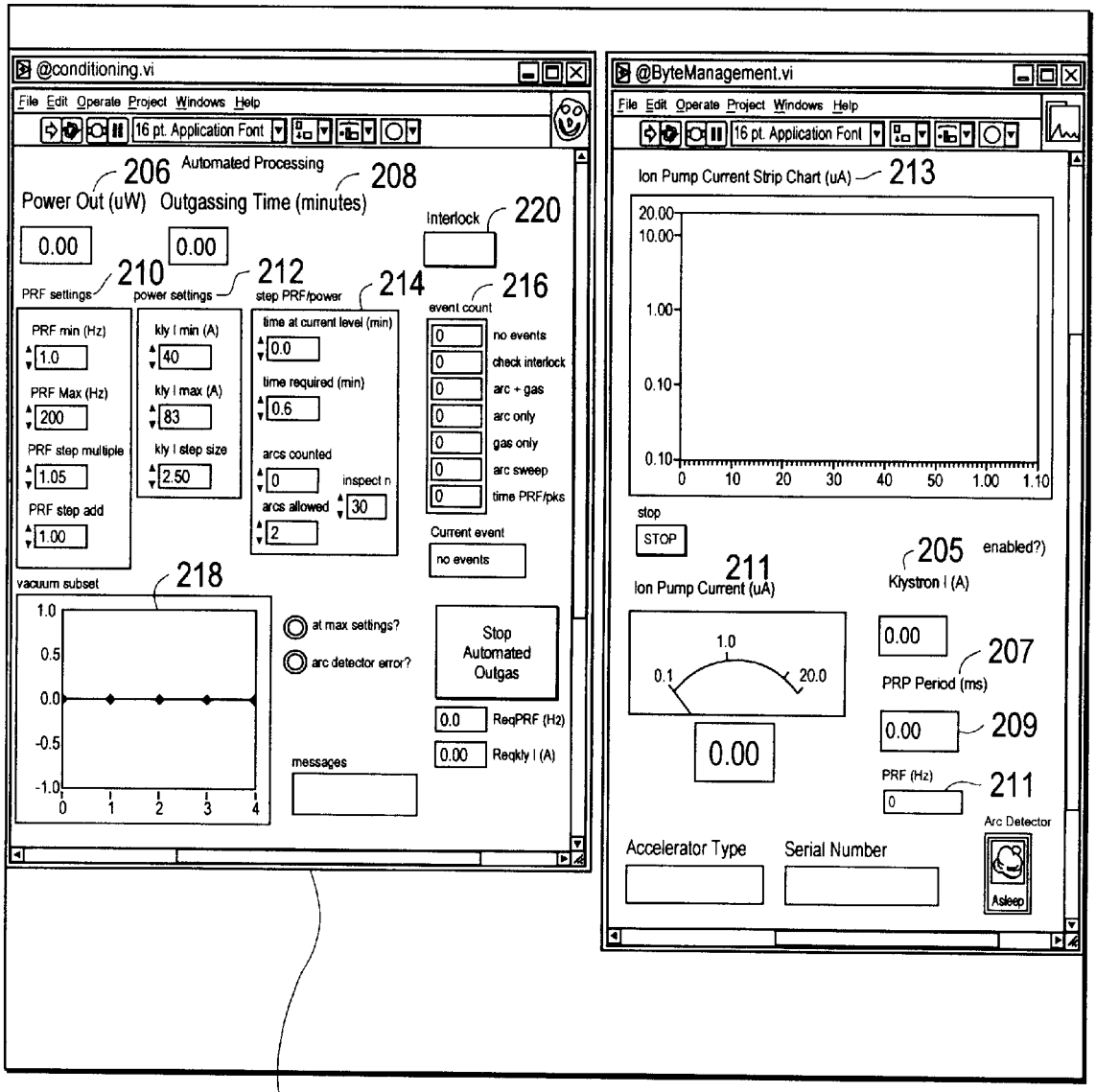
FIG. 3 illustrates the user interface screen of the automated conditioning system in accordance with the present invention.

FIG. 3 illustrates the user interface screen 107 of the automated conditioning system in accordance with the present invention. The user interface screen 107 illustrates the key global variables which are to be monitored to condition the accelerator. As the interface screen 107 illustrates, there are two windows, a Take Measurement Window 202 and a Conditioning Window 204. In the Take Measurement Window 202, the ion pump current 203, Klystron current 205, PRP period 207 and PRF 207 are measured constantly. In addition, as is seen, the ion pump current 211 is measured over time via an ion pump strip chart 213. The conditioning window 204 includes power out and outgassing time indicators 206 and 208 respectively. The conditioning window 204 also includes PRF settings 210, power settings 212, a setting for stepping PRF/power 214 and an event counter 216. The Conditioning Window 262 also includes a screen which indicates the vacuum subset 218 and an interlock 220. The operation of the automated conditioning system will now be described in more detail with reference to FIGS. 4 and 5 and in conjunction the following description.

Figure 4:
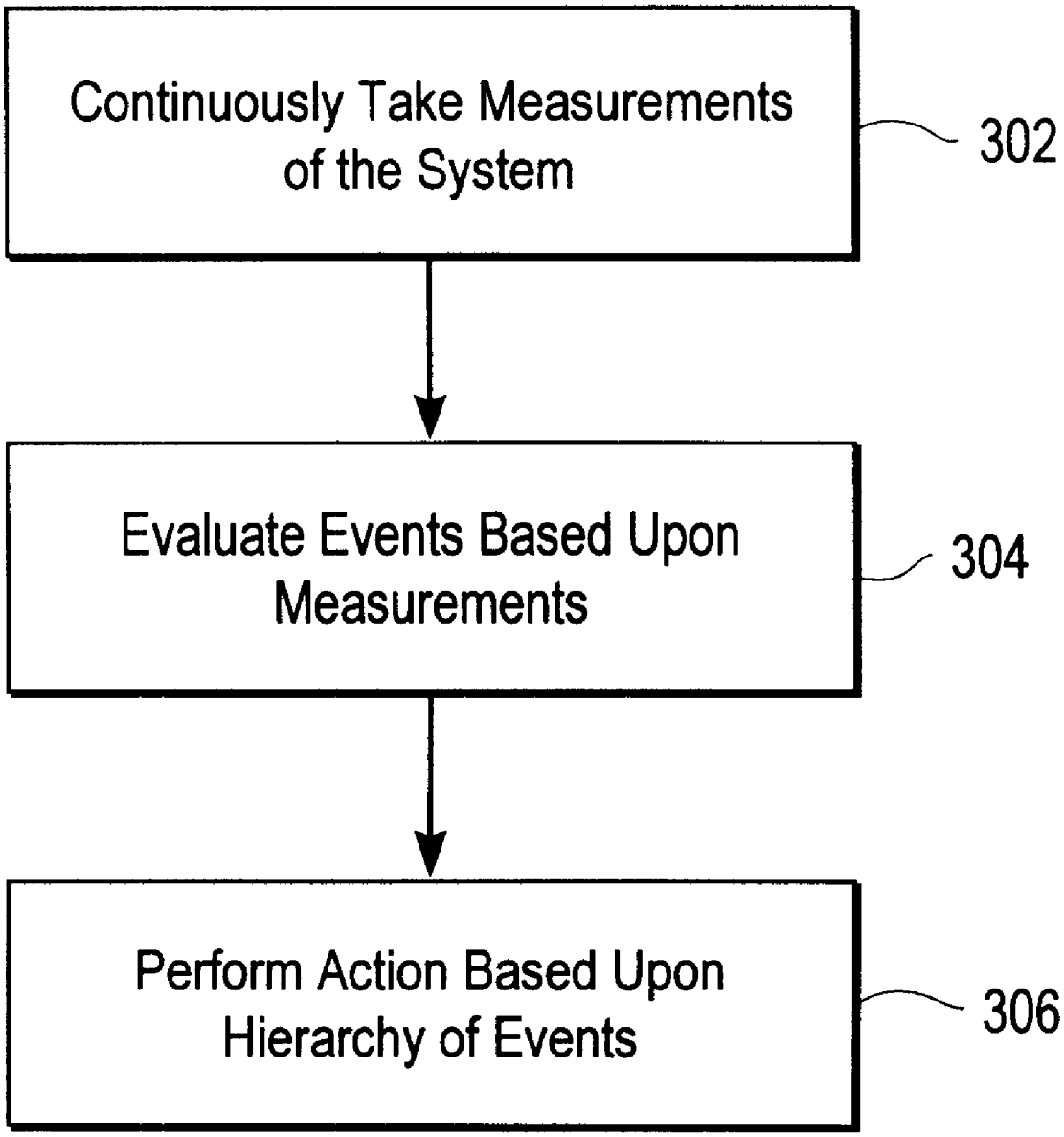
FIG. 4 is a simple flow chart of a system for conditioning an accelerator in accordance with the present invention.

FIG. 4 is a simple flow chart of the operation of system in accordance with the present invention. First, measurements are taken by inspecting global variables of the system, via step 302.

The global variables have a variety of dependencies that are based upon the particular parameters that operate the accelerator 16' (FIG. 2). Hence the specifics of the particular global variables is not the critical feature. The important feature is that the global variables are dependent upon each other based on that operation. One of ordinary skill in the art will recognize there will be a hierarchy of dependency of the global variables and some of the global variables within that hierarchy will need to be adjusted to ensure that conditioning of the accelerator 16' is performed in an efficient fashion.

Second, based on those measurements (and a local history of those measurements), a plurality of True/False (T/F) events are evaluated (e.g., is vacuum OK? did an arc just happen?, should power be increased?), via step 304. Finally, an action is performed in response to a hierarchy of the plurality of events, via step 306. For example, the action may be based upon the most important event of the plurality of events (e.g. if vacuum is poor, then power won't be increased even if ready to otherwise). This methodology takes care of many dependencies implicitly and allows easy modification by adding more events to the chain as necessary. To more particularly describe the present invention, refer to the following discussion in conjunction with FIG. 5.

Figure 5:
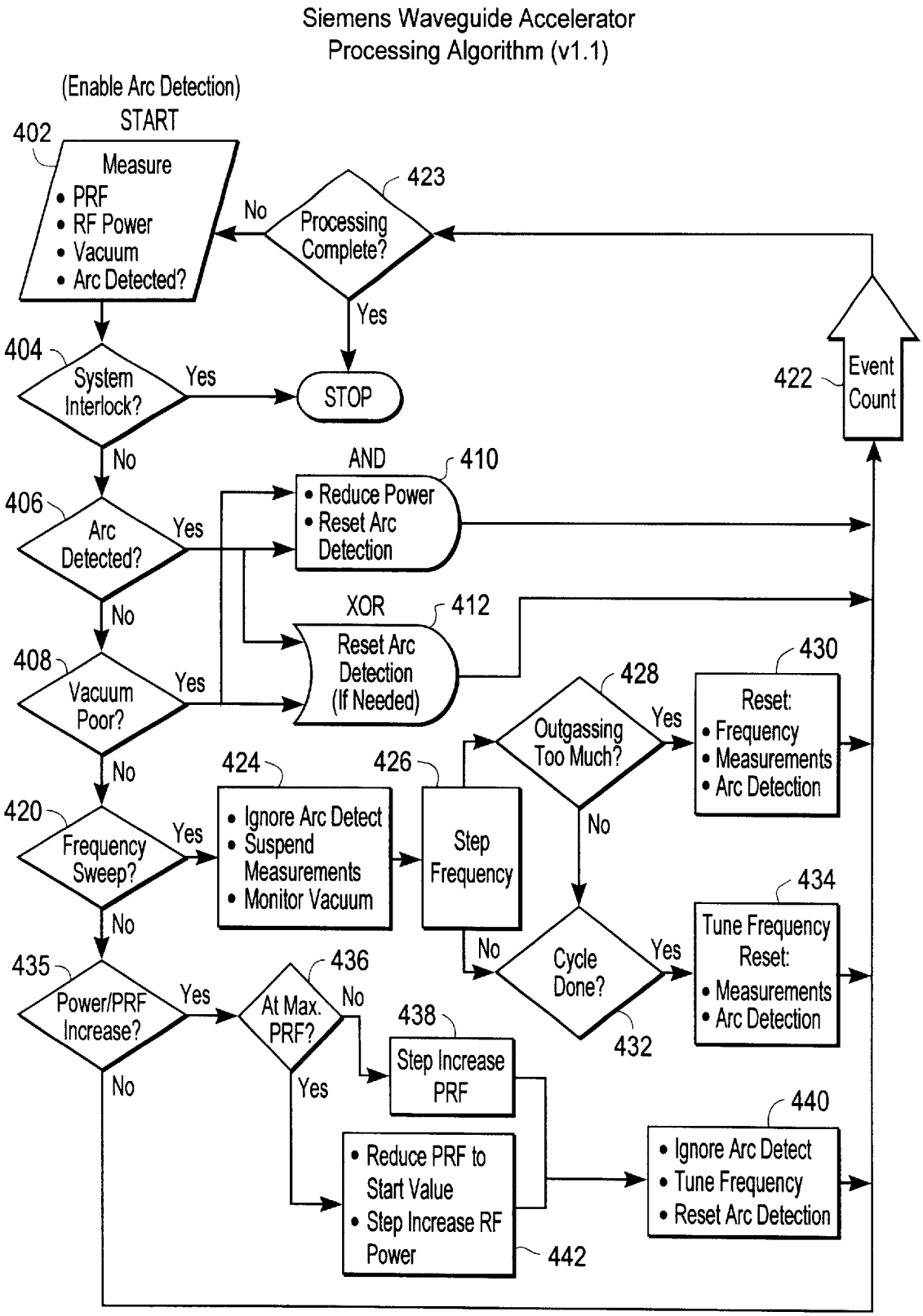
FIG. 5 is a more detailed flow chart of the system for conditioning an accelerator in accordance with the present invention.

FIG. 5 is a more detailed flow chart of the system for conditioning an accelerator in accordance with the present invention. Firstly, measurements are taken of the global variables, via step 402. In a preferred embodiment, these measurements relate to the pulse repetition frequency (PRF), radio frequency power (RF Power), the state of the vacuum (Vacuum), and whether the arc is detected (Arc Detected). In a preferred embodiment, a method for arc detection comprises setting up predetermined limits on the waveforms related to arc detection on the oscilloscope and then sending a service request to service processor if the waveform is outside those predetermined limits.

Next, it is determined if a system interlock is activated, via step 404 (such as, is the door to the system 100 open?). If the system interlock is activated, then all processing stops. However, if the system interlock is not activated, then it is determined if an arc is detected and if the vacuum is poor, via steps 406 and 408. If the arc detected and the vacuum is poor, then the PRF is reduced and the arc detection is reset, via And gate 410. However, if either the arc detection (step 406) or the vacuum is poor (step 408) is not active, a reset of the arc detection is provided via OR gate 412. After the AND gate or OR gate determinators, the event is counted, via step 422. The event counter provides a running count of the different global variable determinators. A determination is then made whether the processing is complete, via step 423. If the processing is complete then all processing stops. However, if processing is not complete then return to the measurement step 402 and the process is repeated until the accelerator is properly conditioned.

In addition, the conditioning system causes a frequency sweep determination to be made after the arc detection and vacuum poor determinations (steps 406 and 408), via step 420. If it is determined that there is a frequency sweep required, then a series of actions are taken, via step 424. These actions comprise ignoring the arc detection, suspending all measurements and monitoring the vacuum. Next, the frequency is stepped, via step 426 and a determination is made of whether there is too much outgassing, via step 428. If there is too much outgassing, then the frequency, measurements of the global variables and arc detection are all reset, via step 430 and return to step 423.

If the outgassing is not too much, then it is determined whether the cycle is completed, via step 432. If the cycle is not completed, then the frequency is stepped again, via step 426. However, if the cycle is completed, then the frequency is tuned, the measurements of the global variables are reset and the arc detection is reset, via step 434 and return to step 423. On the other hand, if there is no frequency sweep required, then it is determined whether RF Power/PRF should be increased, via step 435.

If no increase to the RF Power/PRF is required, then return to the event counter 422. If it is determined that RF Power/PRF should be increased, first a determination is made as to whether the PRF is at a maximum value, via step 436. If the PRF is not at a maximum value, then the PRF should be increased by a step, via step 438. Next, arc detection is ignored, the frequency is tuned and the arc detector is reset, via step 440. Thereafter, return to step 423. If the PRF is at a maximum value, via step 436, the PRF is reduced to a start value and the RF Power is increased by a step, via step 442. Thereafter, step 440 is repeated and return to step 423. Thereafter the conditioning process is performed repeatedly to condition the accelerator as shown in the above-described with respect to FIG. 5.

Accordingly, a system and method in accordance with the present invention allows an accelerator to be conditioned unattended. The system and method in accordance with the present invention combines software and hardware to measure global variables and modifies the condition of the accelerator 16' based upon those variables. Through the use of a system and method in accordance with the present invention conditioning can proceed in small systematic steps, thereby resulting in a better-conditioned accelerator. Accordingly, an improvement in both the performance and longevity of the accelerator 16' will result due to the reduction in arcing and dark current. Finally a significant savings in the overall costs will result from the utilization of a system and method in accordance with the present invention.

Although the present invention has been described in accordance with the embodiments shown, one of ordinary skill in the art will readily recognize that there could be variations to the embodiments and those variations would be within the spirit and scope of the present invention. Accordingly, many modifications may be made by one or ordinary skill in the art without departing from the spirit and scope of the appended claims.

What is claimed is:

1. A method for automatically conditioning a linear accelerator comprising the steps of:

(a) continuously measuring a plurality of global variables of the accelerator;

(b) evaluating a plurality of events based upon the measurement of the plurality global variables, the plurality of events having a hierarchy; and (c) performing an action in response to the hierarchy of the plurality of events.

2. The method of claim 1 wherein the action is performed in response to the most important of the plurality of events.

3. The method of claim 2 wherein the global variables comprise a pulse repetition frequency (PRF), a radio frequency power (RF power), a state of the vacuum and whether arcing is detected.

4. A system for automatically conditioning a linear accelerator comprising:

a Klystron rack which provides radio frequency power to the accelerator;

a control console for controlling the RF power to the Klystron rack; and a computer system coupled to the at least one interface, the computer system for continuously measuring a plurality of global variables of the accelerator;

evaluating a plurality of events based upon the measurement of the plurality global variables, the plurality of events having a hierarchy; and and performing an action in response to the hierarchy of the plurality of events until the accelerator is optimally conditioned.

5. The method of claim 4 wherein the at least one interface includes first and second interfaces.

6. The system of claim 5 which includes an ion pump supply coupled to the accelerator and the first interface.

7. The system of claim 6 which includes a first oscilloscope for obtaining a Klystron current reading from the Klystron rack and for providing a signal indicative of that reading to the second interface.

8. The system of claim 7 which includes a second oscilloscope for obtaining a reflected RF power reading from a feed line to the accelerator and for providing a signal indicative of that reading to the second interface.

9. The system of claim 4 wherein the computer system includes a program for causing the accelerator to be optimally conditioned.

10. The system of claim 9 wherein the control console provides signals to the Klystron rack for controlling the PRF, the RF power and the frequency sweep to the accelerator based upon the program.

11. A computer readable medium containing program instructions for automatically conditioning a linear accelerator, the program instructions for:

(a) continuously measuring a plurality of global variables of the accelerator;

(b) evaluating a plurality of events based upon the measurement of the plurality global variables, the plurality of events having a hierarchy; and (c) performing an action in response to the hierarchy of the plurality of events.

12. The computer readable medium of claim 11 wherein the action is performed in response to the most important of the plurality of events.

13. The computer readable medium of claim 12 wherein the global variables comprises a pulse repetition frequency (PRF), a radio frequency power (RF power), a state of the vacuum and whether arcing is detected.

* * * * *